United States Patent [19]

Safir

[11] 4,124,252

[45] Nov. 7, 1978

[54] BACK SUPPORT WITH CONTROLLABLE FIRMNESS

[76] Inventor: Julian R. Safir, 138 Colony Ct. North, Snyder, N.Y. 14206

[21] Appl. No.: 816,034

[22] Filed: Jul. 15, 1977

[51] Int. Cl.[2] ..... A47C 7/02

[52] U.S. Cl. ..... 297/452; 5/DIG. 2; 297/284

[58] Field of Search ..... 5/211-213, 5/278, 345 R, 351, DIG. 2; 267/89; 297/284, 452

[56] References Cited

U.S. PATENT DOCUMENTS

| | | | |
|---|---|---|---|
| 2,874,390 | 2/1959 | Stone | 5/DIG. 2 |
| 3,085,259 | 4/1963 | Sandor | 5/DIG. 2 |
| 3,095,188 | 6/1963 | Giese | 297/284 UX |
| 3,241,879 | 3/1966 | Castello et al. | 297/284 |
| 3,490,084 | 1/1970 | Schuster | 297/284 X |

*Primary Examiner*—James C. Mitchell

*Attorney, Agent, or Firm*—Irvin A. Lavine

[57] ABSTRACT

A back support comprising a pad of resilient, compressible material having a supporting face for engagement by the back of a person, and apparatus for controllably compressing the pad parallel to the supporting face, comprising a shaft passing parallel to the supporting face and having left hand and right hand threads with threaded followers on the shaft anchored to the pad at spaced points.

16 Claims, 4 Drawing Figures

BACK SUPPORT WITH CONTROLLABLE FIRMNESS

BACKGROUND OF THE INVENTION

The present invention relates to back supports, and more particularly, to a support which is of selectively variable degrees of hardness.

There have been provided in the prior art a number of disclosures of back supports, and of mattresses, and the like, some of which are directed to the problem of varying the resiliency or hardness or softness of the back support or mattress.

Stone U.S. Pat. No. 2,874,390 describes a mattress and cushion construction which includes interior coil springs which support a padding that is to be engaged by the body of a person. The coil springs are supported on groups of parallel upper rods, and below these upper rods are lower rods, against which rests another set of coil springs which engage padding on the opposite face. A mechanism is provided for moving the upper and lower rods towards or away from each other, the mechanism comprising a rod having left and right hand threads, nuts mounted on the threads, a first pair of arms extending from the nuts to one of the rods, and a second pair of arms extending from the nuts to the other rod. The movement of the rods towards or away from each other is stated to have the effect of varying the resiliency of the mattress, to taste. This patent also discloses that instead of coil springs, foam rubber or similar resilient material may be employed, and in such case a flat surface such as a board may be used to bear against and compress the resilient material uniformly throughout the mattress, and that in such an arrangement, the noted upper and lower rods would bear against and move these flat surfaces. The foregoing disclosure is one which requires boards to be mounted on and extend along a resilient pad, and to compress the pad generally perpendicularly to the face thereof upon which the person rests. Further, the only suggestion provided is of a construction in which the compression of the pad will be uniform.

Also known is Giese U.S. Pat. No. 3,095,188, which is directed to a back rest which will effectively support the lower part of the spine, and which can be adjusted to individual requirements, the back rest being used in a motor vehicle. There is disclosed a layer of foam rubber, having a covering, with a spring supporting it, and of generally part-elliptical shape, having a pair of spaced, free ends which are connected to movable elements to bring the free ends closer together, or permit them to move further apart. Such movement will vary the configuration of the spring, causing it to arch more or less, and thereby change the resiliency of the back rest. In this construction, there is no variation in the resiliency of the foam rubber pad, but only of the noted spring.

Sherman U.S. Pat. No. 3,608,960 is directed to a seat back, and generally provides an adjustable cushion contour, in order that the seat back may be comfortable to people of various anatomical shapes.

Schuster U.S. Pat. No. 3,490,084 and Schuster U.S. Pat. No. 3,851,430 disclose cushions having a foam rubber or plastic layer which is resilient and has a wire or rod extending through it, on which are threaded a plurality of bead-like elements. By providing more or less tension to the ends of the wire or rod, more or less resistance to curving or arching of the wire or rod under load is provided, and accordingly this construction provides variable support for the foam plastic or rubber cushion.

SUMMARY OF THE INVENTION

The present invention is directed to a back support, which is made of a resilient, compressible pad of material, such as foam rubber or the like, together with a mechanism for permitting the selective varying of the hardness or resiliency of one or more selected regions of the pad or cushion. This is accomplished by a mechanism which moves towards each other portions of the sides of the compressible, resilient pad. Preferably, the mechanism takes the form of one or more shafts having left hand and right hand threads, threaded sleeves on each of the separate threaded portions of the shaft, with the opposite sides or margins of the compressible pad being attached to the threaded sleeves. Preferably, the sleeves are threaded not only interiorly, in order to engage the shaft, but also exteriorly, there being provided a pair of jam nuts threaded on the exterior of each sleeve, and clamping between them edge portions of the compressible, resilient pad.

The present invention back support is preferably portable, comprising a frame which both journals the shaft or shafts, and provides support for the compressible, resilient pad. Thus, the frame is preferably formed of three parallel, coplanar, and horizontally spaced frame elements which journal the shaft or shafts. The middle frame element supports the compressible, resilient pad on a surface. The pad is provided, at its sides, with flange portions, and parts of these flange portions are engaged by the jam nuts, to thereby compress the pad in a direction transverse to its thickness, and generally parallel to the supporting face thereof which engages the back of a person.

The foregoing arrangement permits the use of the back support in, for example, an automobile, where a person will often be required to sit for long periods of time, and with little possibility of significantly changing his posture or the support which he receives from the back support of the automobile. With the present invention, the pad may be varied in resilience, in the manner described, at different regions thereof, so as to give selected resiliency or degree of hardness to different portions of the back of a person.

Among the objects of the present invention are to provide a back support which may be selectively controlled in order to vary the resiliency or firmness or hardness, without the necessity of placing a board or the like on the surface of the compressible pad of the back support which is engaged by the back of a person.

Another object of the present invention is to provide a back support of the above character which is readily constructed, of simple design, and of economical construction.

Other objects and many of the attendant advantages of the present invention will be readily understood from the following specification and drawings.

DESCRIPTION OF THE PREFERRED EMBODIMENT

Figure 1:
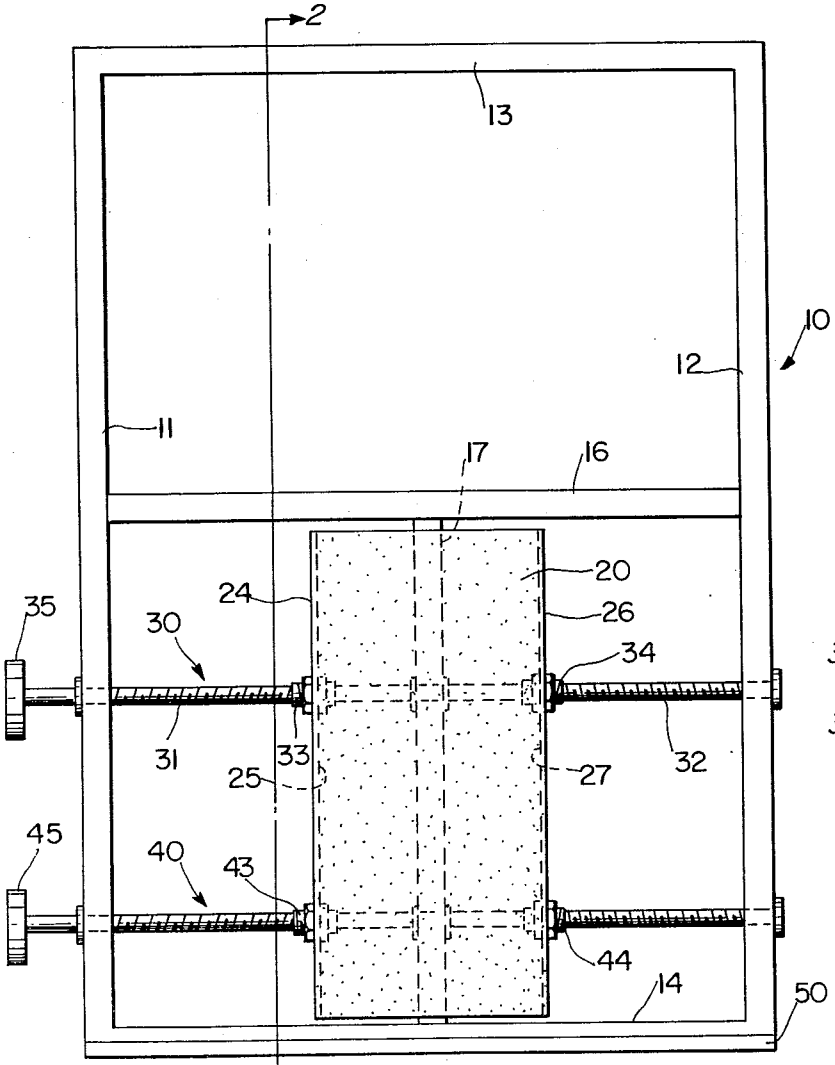
FIG. 1 is an elevational view of a back support in accordance with the present invention.

Referring now to the drawings, wherein like or corresponding reference numerals are used to designate like or correponding parts throughout the several views, there is shown in FIG. 1 a back support generally designated 10, and comprising a frame having side frame members 11 and 12 which extend the full height of the back support, and which are joined at their ends by upper frame member 13, and lower frame member 14. An intermediate horizontal frame member 16 is provided, and there is also provided a vertical frame member 17, secured to and extending between the frame members 14 and 16. The frame members thus described are all coplanar, with the frame members 11, 12 and 17 being vertical, and in horizontally spaced relationship.

Figure 3:
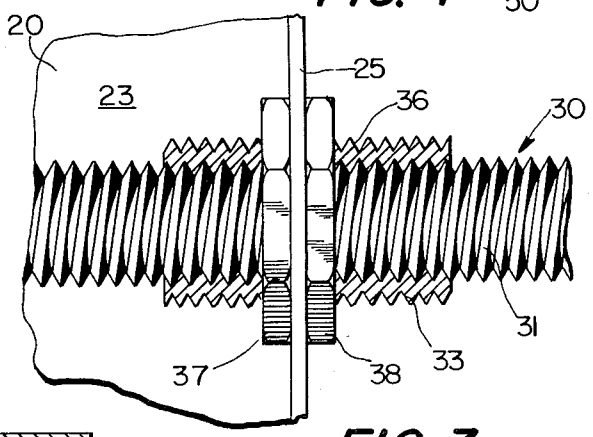
FIG. 3 is a view taken on the line 3—3 of FIG. 2.

A pad 20 is provided, made of suitable compressible, resilient material. A suitable foam rubber material, or foam plastic material may be used. The pad 20 may have a front face 21 (see FIG. 2) which is preferably provided with a suitable covering 22. Thus, the face 21 of pad 20, covered by covering 22, is accessible to be engaged by the back of a person. Opposite the face 21, as shown in FIG. 3, is a rear face 23. The pad has a thickness which is defined between the front, supporting face 21 and the rear face 23.

Figure 2:
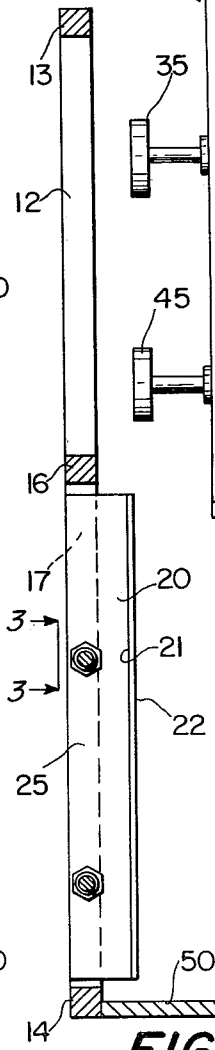
FIG. 2 is a cross sectional view taken on the line 2—2 of FIG. 1.

Referring again to FIG. 1, the rear face 23 of the pad 20 lies against and is supported by the intermediate vertical frame member 17: it may be secured thereto by suitable adhesive. At its sides 24 and 26, the pad 20 has flange-like portions 25 and 27 which project away from the face 21, and as shown in FIG. 2, the flange-like portions 25 and 27 (of which only flange-like portion 25 is shown in FIG. 2) project to the plane of the rear of the frame.

In order to control the firmness of the pad 20, one or more portions of at least one side is moved towards the opposite side of the pad. Preferably, opposite side portions of the pad are moved towards and away from each other. This is accomplished by an upper shaft 30 having right hand threads 31 on one portion and left hand threads 32 on another portion. The shaft 30 is suitably journaled in the frame elements 11, 17 and 12, for rotation. A sleeve 33 is threaded on the right hand threads 31, and a sleeve 34 is threaded on the left hand threads 32. Thus, rotation of the threaded shaft 30, as by the handle 35, will cause the sleeves 32 and 34 to move towards or away from each other, depending upon the direction of rotation.

Each of the sleeves is exteriorly threaded, and each of the sleeves is substantially identical, except for the direction of the threads. Referring to FIG. 3, there may be seen the shaft 30, with the threads 31 and the sleeve 33, with the exterior threads 36 thereon. A pair of jam nuts 37 and 38 are threaded on the exterior threads 36 of the sleeve 33, and capture or clamp between them the flange-like portion 25 of the pad 20. As will be understood, the same construction which is shown in FIG. 3 is provided for the sleeve 34, with the jam nuts clamping between them the flange-like portion 27. Accordingly, by the above noted rotation of the shaft 30, the sleeves 33 and 34 may be moved towards or away from each other, and due to the holding of the flange-like portions 25 and 27, portions of the sides 24 and 26 of the pad 20 will be moved towards and away from each other.

A second shaft 40 is provided, and is essentially the same as the shaft 30. Thus, the shaft 40, having left and right hand threads, is provided with sleeves 43 and 44 and a handle 45, and the action thereof is essentially the same as that of the shaft 30.

There may be provided, as desired, a seat cover 50, although this is not required.

Figure 4:
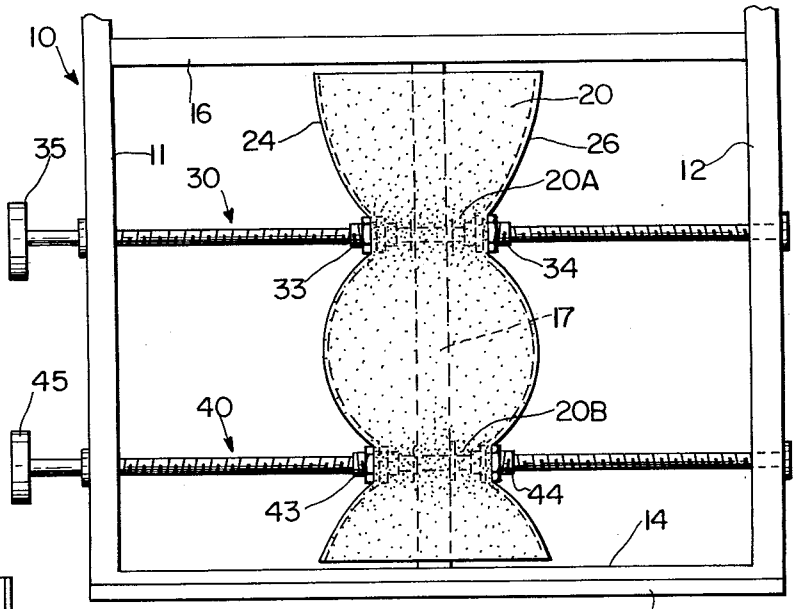
FIG. 4 is an elevational view of the back support of FIG. 1, and showing the pad of the back support with regions thereof compressed.

FIG. 4 illustrates the operation of the back support as above described. There is seen therein the frame, including the frame members 11, 12, 16, 17 and 14. Also seen are the threaded shafts 30 and 40, with their handles 35 and 45 respectively. A region 20 A of the pad 20 has been compressed, due to the movement towards each other of the sleeves 33 and 34, which carry with them portions of the sides 24 and 26 of the pad 20. The region 20 A is, therefore, relatively less resilient, and is more firm and more solid, than the regions or areas of the pad 20 which are not compressed. Similarly, the region 20 B of the pad 20 has been compressed by the movement of the sleeves 43 and 44 towards each other, due to rotation of the shaft 40 by handle 45. Thus, the degree of resiliency or firmness of the region 20 B is selectively controlled, and may be of more or less firmness than the region 20 A, which is also selectively and independently controlled.

It will be obvious to those skilled in the art that various changes may be made without departing from the spirit of the invention, and therefore the invention is not limited to what is shown in the drawings and described in the specification but only as indicated in the appended claims.

I claim:

1. A back support for providing selectively controllable firmness for the back of a person comprising:
   a pad of compressible, resilient material having a supporting face, against which the back of a person is engageable for support by said pad, said supporting face being bounded at least in part by sides,
   means for compressing at least a portion of said pad by moving at least one side towards an opposite side.

2. A back support according to claim 1, said last mentioned means engaging a portion of said pad and movable substantially parallel to said supporting face.

3. A back support according to claim 1, said last mentioned means comprising plural means for compressing plural portions of said pad at spaced locations up and down said pad.

4. A back support according to claim 1, wherein said last mentioned means comprises a shaft having left hand and right hand threads, means for journalling said shaft, threaded sleeves on said shaft, and means for connecting said sleeves to said pad.

5. A back support according to claim 4, said last mentioned means comprising exterior threads on said sleeves, a pair of nuts threaded on each of said sleeves, and a portion of said pad locked between each pair of said nuts.

6. A back support as set forth in claim 5, wherein portions of said pad project away from said supporting face.

7. A back support according to claim 4, and comprising a second shaft parallel to said shaft, means for journalling said second shaft, threaded sleeves on said second shaft, and means for connecting said last mentioned sleeves to said pad.

8. A back support according to claim 4, said means for journalling said shaft comprising a frame.

9. A back support according to claim 8, wherein said frame comprises horizontally spaced frame members, said shaft being journalled in at least one said frame member, and said pad being supported at least in part on a said frame member.

10. A back support for providing variable firmness to at least one region of the back of a person resting against a supporting face thereof comprising:

a frame, a compressible resilient pad supported by and extending outwardly of said frame, said pad having a supporting face transverse to the thickness thereof for engagement by the back of a person resting against said pad, and means for compressing at least one region of said pad transversely of the thickness thereof a selected amount and retaining said pad in the selected degree of compression.

11. The back support of claim 10, said last mentioned means comprising means for urging at least one marginal portion of said pad towards an opposite marginal portion thereof.

12. The back support of claim 10, said back support comprising plural means for compressing spaced regions of said pad transversely of the thickness thereof independently of each other and for retaining each said region in the selected degree of compression.

13. The back support of claim 1, said supporting face of said pad being accessible for engagement by the back of a person.

14. The back support of claim 13, said pad being of foam material.

15. The back support of claim 10, said supporting face of said pad being accessible for engagement by the back of a person.

16. The back support of claim 15, said pad being of foam material.

* * * * *